US011027573B2

(12) United States Patent
Hsu

(10) Patent No.: US 11,027,573 B2
(45) Date of Patent: Jun. 8, 2021

(54) PEN

(71) Applicant: CHICONY ELECTRONICS CO., LTD., New Taipei (TW)

(72) Inventor: Cheng-Chi Hsu, New Taipei (TW)

(73) Assignee: CHICONY ELECTRONICS CO., LTD., New Taipei (TW)

( * ) Notice: Subject to any disclaimer, the term of this patent is extended or adjusted under 35 U.S.C. 154(b) by 39 days.

(21) Appl. No.: 16/442,891

(22) Filed: Jun. 17, 2019

(65) Prior Publication Data

US 2020/0282761 A1 Sep. 10, 2020

(30) Foreign Application Priority Data

Mar. 8, 2019 (TW) ..... 108107918

(51) Int. Cl.

| | |
|---|---|
| ***B43K 7/00*** | (2006.01) |
| ***B43K 15/00*** | (2006.01) |
| ***B43K 23/12*** | (2006.01) |
| ***B43K 5/00*** | (2006.01) |
| ***B43K 23/08*** | (2006.01) |

(52) U.S. Cl.

CPC ..... *B43K 7/005* (2013.01); *B43K 15/00* (2013.01); *B43K 23/12* (2013.01); *B43K 5/005* (2013.01); *B43K 23/08* (2013.01)

(58) Field of Classification Search

CPC ..... B43K 7/005; B43K 15/00; B43K 23/12; B43K 5/005; B43K 23/08; B43K 5/00; B43K 8/003; B43K 15/02; B43K 21/006; B43K 24/02; B43K 24/08; B43K 24/088; B43K 24/084; B43K 24/086; B43K 24/16

USPC ..... 401/109–113, 98, 202, 213, 247, 251, 401/262, 269

See application file for complete search history.

(56) References Cited

U.S. PATENT DOCUMENTS

| | | | | |
|---|---|---|---|---|
| 3,544,227 A * | 12/1970 | Green | B43K 29/02 401/52 |
| 4,943,175 A * | 7/1990 | Heim | B43K 24/084 401/111 |
| 6,257,787 B1 * | 7/2001 | Kirk | B43K 7/00 401/104 |
| 6,554,518 B1 * | 4/2003 | Pei | B43K 24/084 401/110 |

(Continued)

FOREIGN PATENT DOCUMENTS

| | | |
|---|---|---|
| CN | 106648161 A | 5/2017 |
| TW | M342550 U | 10/2008 |
| TW | M418811 U | 12/2011 |

*Primary Examiner* — David J Walczak

(74) *Attorney, Agent, or Firm* — Muncy, Geissler, Olds and Lowe, P.C.

(57) ABSTRACT

A pen includes a pen tube, a connection structure, a cap and an elastic unit. The pen tube includes a pen tube case and a thread portion provided at the pen tube case. The connection structure includes a main body, a corresponding thread portion and an elastic unit fastener. The corresponding thread fastener is located at the main body and is for joining with the thread portion. The elastic unit fastener is provided at the main body. The cap includes a cap case and an elastic unit corresponding fastener provided at the cap case. The two ends of the elastic unit are respectively fastened to the elastic unit fastener and the elastic unit corresponding fastener.

10 Claims, 3 Drawing Sheets

(56) References Cited

U.S. PATENT DOCUMENTS

| | | | | |
|---|---|---|---|---|
| 7,044,672 | B2 * | 5/2006 | Yu | B43K 29/10 362/118 |
| 2017/0008331 | A1 | 1/2017 | Kuo | |

* cited by examiner

PEN

BACKGROUND OF THE INVENTION

Field of the Invention

The present invention relates to a pen, and more particularly to a pen having a pen tube having a non-round tubular appearance.

Description of the Prior Art

A common ballpoint pen, mechanical pen or stylus has a round tubular pen body and a cap. A lead, a refill, an ink refill, a spring or electronic components are installed in the round tubular pen body, and one end of the pen body is provided with a thread. The cap can also be provided with a thread for joining with the thread of the pen body. Alternatively, a lead, a refill, an ink refill, a spring or electronic components can also be placed in the cap. When the cap and the pen body are joined, the pen appears cylindrical in shape.

However, certain pens are designed with a special form, e.g., a regular hexagon, and thus a pen body and cap thereof are also correspondingly designed as regular hexagons. Thus, the threads on the pen body and the cap designed in such special form require extremely precise calculation and hardware processing in order to allow the regular hexagonal cases of the pen body and the cap to exactly align with each other when the threads on the pen body and the cap are mutually rotated to the end. Therefore, for a pen designed with a special form or a non-round tubular pen, a conventional structure of threads on a pen and a cap can significantly increase design and production costs.

Therefore, there is a need for a pen having reduced production costs and a case that can be readily assembled into a special design form.

SUMMARY OF THE INVENTION

It is a primary object of the present invention to provide a pen having a pen tube having a non-round tubular appearance.

To achieve the above object, a pen of the present invention includes a pen tube, a connection structure, a cap and an elastic unit. The pen tube includes a pen case and a thread portion provided at the pen case. The connection structure includes a main body, a corresponding thread portion and an elastic unit fastener. The corresponding thread portion is provided at the main body and is joined with the thread portion. The elastic unit fastener is provided at the main body. The cap includes a cap case and an elastic unit corresponding fastener provided at the pen case. The two ends of the elastic unit are respectively fastened to the elastic unit fastener and the elastic unit corresponding fastener.

According to an embodiment of the present invention, the connection structure further includes at least one connection structure through hole provided at the main body, and the cap further includes at least one cap through hole provided at the cap case, wherein a position of the at least one cap through hole corresponds to that of the at least one connection structure through hole.

According to an embodiment of the present invention, the pen further includes a fastening pin, which passes through the at least one connection structure through hole and the at least one cap through hole.

According to an embodiment of the present invention, the at least one connection structure through hole is located between the corresponding thread portion and the elastic unit fastener.

According to an embodiment of the present invention, a size of the at least one connection structure through hole is larger than a size of the at least one cap through hole.

According to an embodiment of the present invention, the pen tube further includes a positioning portion, and the cap further includes a corresponding positioning portion, wherein a shape of the positioning portion corresponds to that of the corresponding positioning portion.

According to an embodiment of the present invention, the pen tube further includes a form design portion, and the cap further includes a corresponding form design portion. When the positioning portion is joined with the corresponding positioning portion, the form design portion is aligned with the corresponding form design portion.

According to an embodiment of the present invention, a shape of the form design portion is a plane.

According to an embodiment of the present invention, the pen further includes a battery located in the pen tube.

According to an embodiment of the present invention, the pen further includes a conductive elastic unit connected to the battery.

DETAILED DESCRIPTION OF THE EMBODIMENTS

Figure 1:
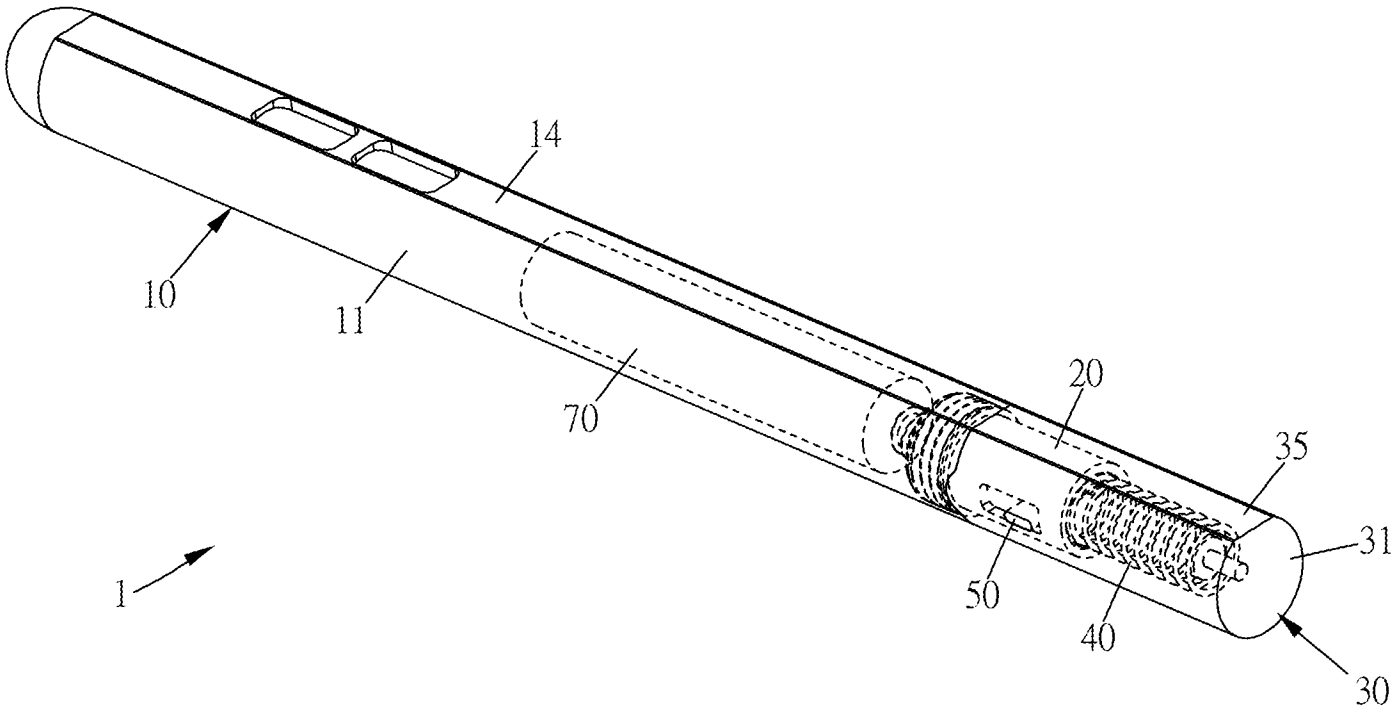
FIG. 1 is a schematic diagram of a pen according to an embodiment of the present invention.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
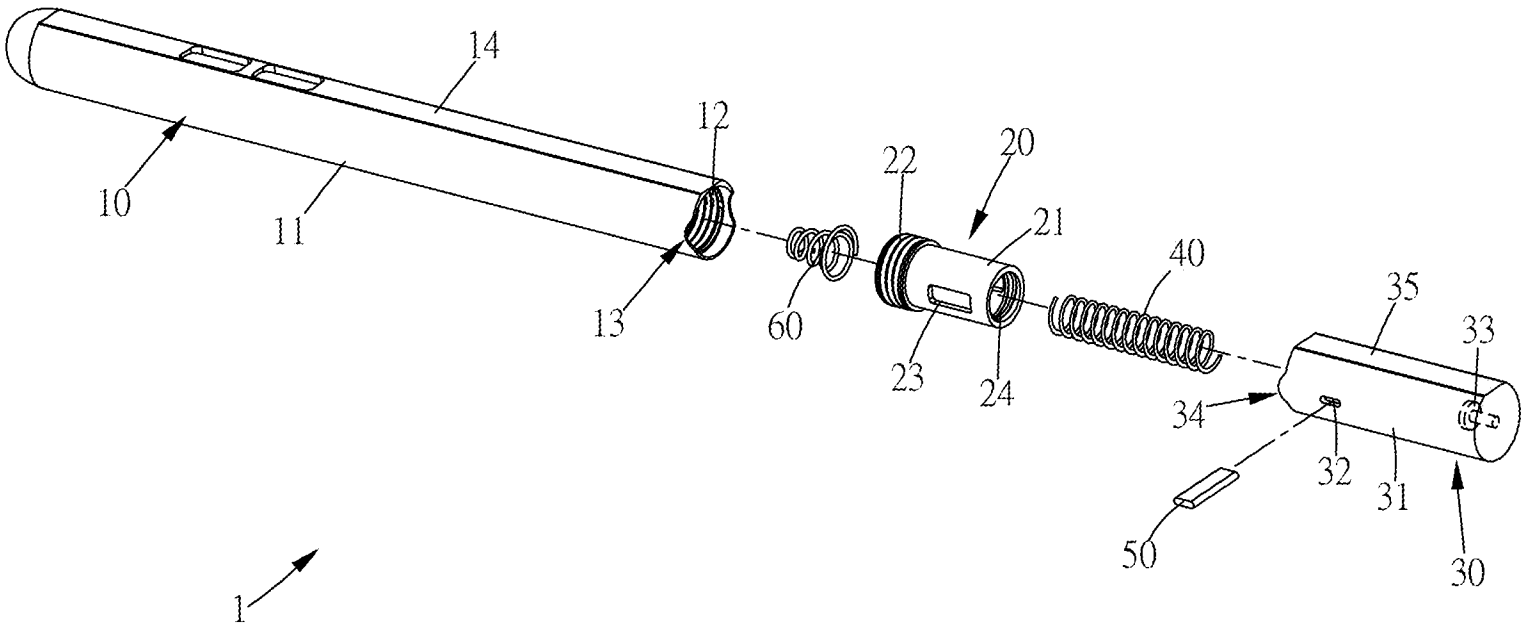
FIG. 2 is an exploded perspective diagram of a pen according to an embodiment of the present invention.
Figure 3:
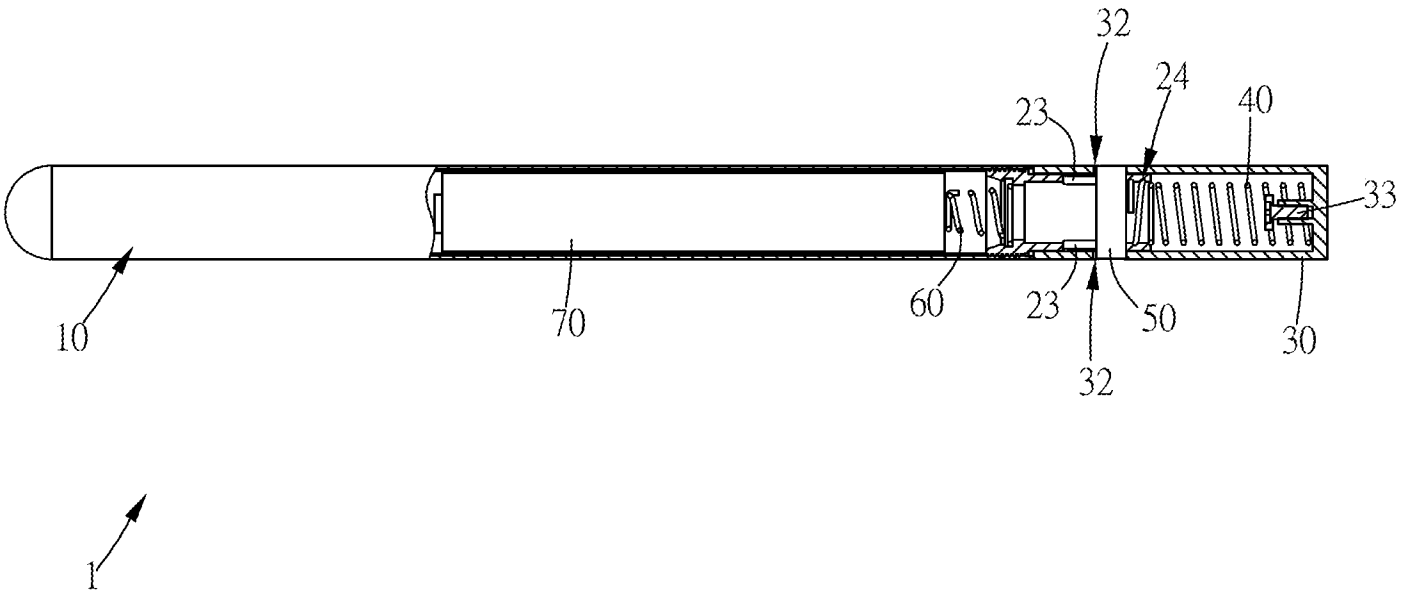
FIG. 3 is a partial section diagram of a pen according to an embodiment of the present invention.

Refer to FIG. 1 to FIG. 3 for a pen according to an embodiment of the present invention. FIG. 1 shows a schematic diagram of a pen according to an embodiment of the present invention; FIG. 2 shows an exploded perspective diagram of a pen according to an embodiment of the present invention; FIG. 3 shows a partial section diagram of a pen according to an embodiment of the present invention.

As shown in FIG. 1 and FIG. 2, in one embodiment of the present invention, a pen 1 provides effects of reduced production costs and ready assembly of a case by assembly workers into a special design form (e.g. the case is non-round tubular). The pen 1 is, for example, a stylus and is not limited thereto. The pen 1 can also be a pen device such as a laser pen, a ballpoint pen or a mechanical pen. The pen 1 includes a pen tube 10, a connection structure 20, a cap 30, an elastic unit 40, a fastening pin 50, a conductive elastic unit 60 and a battery 70.

In one embodiment of the present invention, the pen tube 10 is for matching with the cap 30 to accommodate the internal components of the pen 1. The pen tube 10 includes a pen tube case 11, a thread portion 12, a positioning portion 13 and a form design portion 14. The pen tube case 11 is a hollow tube, of which an inner wall is a tubular structure and an outer wall is a non-tubular structure. The pen tube case 11 is for accommodating the internal components of the pen 1. The thread portion 12 is an inner thread and is provided at an inner side on one end of the pen tube case 11 facing the cap 30. The positioning portion 13 is a recess and is provided on one end of the pen tube case 11 facing the cap 30. The form design portion 14 is a plane and is provided on the pen tube case 11. However, the shape of the form design portion 14 is not limited to being a plane and can be modified into other shapes according to appearance design requirements.

In one embodiment of the present invention, as shown in FIG. 1 to FIG. 3, the connection structure 20 is for joining the pen tube 10 with the cap 30 and for adjusting the joining angle between the pen tube 10 and the cap 30. The connection structure 20 includes a main body 21, a corresponding thread portion 22, two connection structure through holes 23, and an elastic unit fastener 24. The main body 21 is a cylinder and can be place into the pen tube 10 and the cap 30 which are joined with each other. The corresponding thread portion 22 is a ring having an outer thread, is provided on one end of the main body 21 facing the pen tube 10, and is for joining with the thread portion 12. However, the forms of the thread portion 12 and the corresponding thread portion 22 are not limited to the above examples; the corresponding thread portion 22 can be modified to an inner thread and the thread portion 12 can be correspondingly modified to an outer thread. The two connection structure through holes 23 are provided at the main body 21, are for accommodating the fastening pin 50, and are both located between the corresponding thread portion 22 and the elastic unit fastener 24. However, the quantity of the connection structure through holes 23 is not limited to two. In other embodiments, the quantity of the connection structure through holes 23 can also be modified to one. The elastic unit fastener 24 is an arc groove, is provided on one end of the main body 21 facing the cap 30, and is for fastening the elastic unit 40. In this embodiment, the elastic unit 40 is, for example but not limited to, a spring.

In one embodiment of the present invention, the cap 30 is for joining with one end of the pen tube 10 so as to match with the pen tube 10 to further accommodate the internal components of the pen 1. The cap 30 includes a cap case 31, two cap through holes 32, an elastic unit corresponding fastener 33, a corresponding positioning portion 34 and a corresponding form design portion 35. The cap case 31 is a hollow tube, of which an inner wall is a tubular structure and an outer wall is a non-tubular structure. The cap case 31 is for accommodating the internal components of the pen 1. The two cap through holes 32 are provided at the cap case 31, and positions of the two cap through holes 32 respectively correspond to those of the two connection structure through holes 23. However, the quantity of the cap through holes 32 is not limited to two and can also be modified to one. A size of the connection structure through holes 23 is larger than a size of the cap through holes 32. The cap through holes 32 are for accommodating the fastening pin 50. The elastic unit corresponding fastener 33 is connected to the cap case 31 and can be wound by one end of the elastic unit 40 so as to fasten the elastic unit 40. In the embodiment, the elastic unit corresponding fastener 33 is a thumbtack-shaped structure; however, the shape and structure of the elastic unit corresponding fastener 33 are not limited to the above examples. The corresponding positioning portion 34 is a protrusion, and a shape of the groove of the positioning portion 13 corresponds to a shape of the protrusion of the corresponding positioning portion 34. The corresponding positioning portion 34 is for joining with the positioning portion 13 to achieve a positioning effect. However, the forms of the positioning portion 13 and the corresponding positioning portion 34 are not limited to the above examples; the positioning portion 13 can be modified to be a protrusion, and the corresponding positioning portion 34 can be correspondingly modified to be a groove. The corresponding form design portion 35 is a plane and is provided on the cap case 31. When the positioning portion 13 and the corresponding positioning portion 34 are joined, a plane of the form design portion 14 is aligned with the plane of the corresponding form design portion 35. However, the shape of the corresponding form design portion 35 is not limited to being a plane and can also be modified to be other shapes according to appearance design requirements.

In one embodiment of the present invention, the two ends of the elastic unit 40 are respectively fastened to the arc groove of the elastic unit fastener 24 and the thumbtack-shaped structure of the elastic unit corresponding fastener 33. The elastic unit 40 provides the connection structure 20 and the cap 30 with an elastic force so as to enable the connection structure 20 and the cap 30 to be close to each other.

In one embodiment of the present invention, the fastening pin 50 passes through the two connection structure through holes 23 and the two cap through holes 32. The fastening pin 50 is for fixing the connection structure 20 at a position in the cap 30. A width of the fastening pin 50 is substantially equal to the size of the cap through holes 32, such that the fastening pin 50 does not move easily and is mutually fastened with the cap through holes 32 once having passed through the cap through holes 32. Further, because the size of the connection structure through holes 23 is greater than that of the cap through holes 32, the size of the connection structure through holes 23 is also larger than the width of the fastening pin 50. Thus, after the fastening pin 50 passes through the connection structure through holes 23, the connection structure 20 is still capable of slightly moving relative to the fastening pin 50, and the cap 30 can also be linked by the fastening pin 50 to slightly move relative to the connection structure 20.

In one embodiment of the present invention, the battery 70 is located in the pen tube 10 and provides power required for a touch function of the pen 1. The conductive elastic unit 60 is a negative electrode spring and has one end thereof connected to the battery 70 and the other end thereof having a larger coil radius. The one end having the larger coil radius can be fastened at an inner side of the ring of the corresponding thread portion 22. The conductive elastic unit 60 is for transmitting power of the battery 70 to components needing power in the pen 1.

When assembly workers are to assemble the pen 1 of the present invention, as shown in FIG. 1 to FIG. 3, one end of the conductive elastic unit 60 having a larger coil radius is fastened at the inner side of the ring of the corresponding thread portion 22, and the battery 70 is placed in the pen case 11. The assembly workers can then fasten one end of the elastic unit 40 to the thumbtack-shaped structure of the elastic unit corresponding fastener 33 and fasten the other end of the elastic unit 40 to the arc groove of the elastic unit fastener 24. Next, the assembly workers can place a part of the main body 21 in the cap case 31 and respectively align the two connection structure through holes 23 with the two cap through holes 32. The assembly workers can then pass the fastening pen 50 through the two connection structure through holes 23 and the two cap through holes 32. Thus, the connection structure 20, the cap 30, the elastic unit 40 and the fastening pin 50 will become joined to one another, and the elastic pulling force of the elastic unit 40 will pull the connection structure 20 and the cap 30 close to each other so as to tightly join the two.

Finally, the assembly workers can rotate the corresponding thread portion 22 into the thread portion 12 to cause the cap 30 gradually to approach the pen tube 10 until the groove of the positioning portion 13 is joined with the protrusion of the corresponding positioning portion 34. When the positioning portion 13 and the corresponding positioning portion 34 are joined, the plane of the form design portion 14 is aligned with the plane of the corresponding form design portion 35 such that the outer shapes of the pen tube 10 and the cap 30 are matched with each other. Further, because the size of the connection structure through holes 23 is greater than that of the fastening pin 50, the fastening pin 50 can move slightly relative to the connection structure 20. That is to say, when the corresponding thread portion 22 is rotated all the way to the end relative to the thread portion 12 but the plane of the form design portion 14 is not yet aligned with the plane of the corresponding form design portion 35 (i.e. the outer shapes of the pen tube 10 and the cap 30 are not yet matched with each other), the cap 30 can still slightly move by means of the moving space between the fastening pin 50 and the connection structure through holes 23 for fine tuning of the position of the corresponding positioning portion 34, so as to enable the positioning portion 13 and the corresponding positioning portion 34 to match with each other and the plane of the form design portion 14 be aligned with the plane of the corresponding form design portion 35. Thus, when the thread rotation angle between the corresponding thread portion 22 and the thread portion 12 is designed and manufactured, highly accurate calculations and hardware processing are not required. The structural error between the corresponding thread portion 22 and the thread portion 12 can still be compensated by a fine tuning effect provided by the moving space between the fastening pin 50 and the connection structure through holes 23.

With the structural design of the pen 1 of the present invention, design production costs of the corresponding thread portion and the thread portion can be reduced, allowing assembly workers to readily assemble a case of a pen into a special design form.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the present disclosure. In view of the foregoing, it is intended that the present disclosure cover modifications and variations of the present disclosure provided they fall within the scope of the following claims.

What is claimed is:

1. A pen, comprising:
a pen tube, comprising:
a pen tube case; and
a thread portion, provided at the pen tube case;
a connection structure, comprising:
a main body;
a corresponding thread portion, provided at the main body, for joining with the thread portion; and
an elastic unit fastener, provided at the main body;
a cap, wherein the main body is located in the cap, the cap comprising;
a cap case; and
an elastic unit corresponding fastener, provided at the cap case; and
an elastic unit, two ends of the elastic unit being respectively fastened to the elastic unit fastener and the elastic unit corresponding fastener,
wherein the elastic unit provides an elastic force so as to enable the connection structure and the cap to be close to each other.

2. The pen as claimed in claim 1, wherein the connection structure further comprises at least one connection structure through hole provided at the main body, the cap further comprises at least one cap through hole provided at the cap case, and a position of the at least one cap through hole corresponds to that of the at least one connection structure through hole.

3. The pen as claimed in claim 2, further comprising:
a fastening pin, passing through the at least one connection structure through hole and the at least one cap through hole.

4. The pen as claimed in claim 2, wherein the at least one connection structure through hole is located between the corresponding thread portion and the elastic unit fastener.

5. The pen as claimed in claim 2, wherein a size of the at least one connection structure through hole is larger than that of the at least one cap through hole.

6. The pen as claimed in claim 1, wherein the pen tube further comprises a positioning portion, the cap further comprises a corresponding positioning portion, and a shape of the positioning portion corresponds to that of the corresponding positioning portion.

7. The pen as claimed in claim 6, wherein the pen tube further comprises a form design portion, the cap further comprises a corresponding form design portion, and the form design portion is aligned with the corresponding form design portion when the positioning portion is joined with the corresponding positioning portion.

8. The pen as claimed in claim 7, wherein a shape of the form design portion is a plane.

9. The pen as claimed in claim 1, further comprising:
a battery, located in the pen tube.

10. The pen as claimed in claim 9, further comprising:
a conductive elastic unit, connected to the battery.

* * * * *